US008727703B2

(12) United States Patent
Laurello et al.

(10) Patent No.: US 8,727,703 B2
(45) Date of Patent: May 20, 2014

(54) GAS TURBINE ENGINE

(75) Inventors: Vincent P. Laurello, Hobe Sound, FL (US); Keith D. Kimmel, North Palm Beach, FL (US); John Orosa, Palm Beach Gardens, FL (US)

(73) Assignee: Siemens Energy, Inc., Orlando, FL (US)

( * ) Notice: Subject to any disclaimer, the term of this patent is extended or adjusted under 35 U.S.C. 154(b) by 748 days.

(21) Appl. No.: 12/876,375

(22) Filed: Sep. 7, 2010

(65) Prior Publication Data

US 2012/0057967 A1 Mar. 8, 2012

(51) Int. Cl.
*F01D 25/08* (2006.01)

(52) U.S. Cl.
USPC ..... 415/115; 415/116; 415/182.1

(58) Field of Classification Search
USPC ..... 415/115, 116, 108, 182.1, 183, 184, 415/185, 178, 144, 229, 145, 175
See application file for complete search history.

(56) References Cited

U.S. PATENT DOCUMENTS

| | | | | |
|---|---|---|---|---|
| 3,826,084 A | | 7/1974 | Branstrom et al. | |
| 4,645,415 A | * | 2/1987 | Hovan et al. | 415/115 |
| 4,657,482 A | * | 4/1987 | Neal | 415/176 |
| 4,991,391 A | | 2/1991 | Kosinski | |
| 5,800,125 A | * | 9/1998 | Largillier et al. | 416/96 R |
| 6,065,282 A | | 5/2000 | Fukue et al. | |
| 7,334,412 B2 | | 2/2008 | Tiemann | |
| 7,600,370 B2 | | 10/2009 | Dawson | |
| 2007/0068165 A1 | * | 3/2007 | Tiemann | 60/751 |
| 2007/0175220 A1 | | 8/2007 | Bland | |
| 2007/0271923 A1 | * | 11/2007 | Dawson | 60/751 |
| 2009/0263243 A1 | | 10/2009 | Little et al. | |

OTHER PUBLICATIONS

U.S. Appl. No. 12/758,065, filed Apr. 12, 2010, entitled Cooling Fluid Pre-Swirl Assembly for a Gas Turbine Engine.

U.S. Appl. No. 12/564,194, filed Sep. 22, 2009, entitled Cover Assembly for Gas Turbine Engine Rotor.

* cited by examiner

*Primary Examiner* — Ned Landrum
*Assistant Examiner* — Justin Seabe

(57) ABSTRACT

A gas turbine engine includes a diffuser section supplying cooling fluid, a rotatable shaft, shaft cover structure disposed about the rotatable shaft, support structure, and a cooling fluid channel between the shaft cover structure and the support structure. The support structure provides structural support for the shaft cover structure and receives cooling fluid from the diffuser section. One of the diffuser section and the support structure comprises a plurality of apertures through which at least a portion of the cooling fluid passes. The cooling fluid channel is in fluid communication with the apertures in the one of the diffuser section and the support structure for supplying cooling fluid to a blade disc structure located in a turbine section of the engine.

18 Claims, 2 Drawing Sheets

GAS TURBINE ENGINE

FIELD OF THE INVENTION

The present invention relates to a gas turbine engine, and more particularly, to a gas turbine engine including a diffuser section that supplies cooling fluid used to cool structure in a turbine section of the gas turbine engine.

BACKGROUND OF THE INVENTION

In gas turbine engines, compressed air discharged from a compressor section and fuel introduced from a source of fuel are mixed together and burned in a combustion section, creating combustion products defining hot working gases. The working gases are directed through a hot gas path in a turbine section, where they expand to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, certain components, such as rotating blade structures within the turbine section, must be cooled with cooling fluid, such as compressor discharge air, to prevent overheating of the components.

SUMMARY OF THE INVENTION

In accordance with a first aspect of the present invention, a gas turbine engine is provided. The gas turbine engine comprises a diffuser section supplying cooling fluid, a rotatable shaft, shaft cover structure disposed about the rotatable shaft, support structure, and a cooling fluid channel between the shaft cover structure and the support structure. The support structure provides structural support for the shaft cover structure and receives cooling fluid from the diffuser section. One of the diffuser section and the support structure comprises a plurality of apertures through which at least a portion of the cooling fluid passes. The cooling fluid channel is in fluid communication with the apertures in the one of the diffuser section and the support structure for supplying cooling fluid to a blade disc structure located in a turbine section of the engine.

The diffuser section may be in fluid communication with a compressor section of the engine, the cooling fluid being provided to the diffuser section from the compressor section.

The diffuser section may comprise an inner diffuser wall that at least partially defines an inner boundary of the diffuser section, the inner diffuser wall including the apertures.

At least one of the apertures may extend through an axially forward portion of the inner diffuser wall, and at least another one of the apertures may be located axially downstream from the at least one aperture extending through the axially forward portion of the inner diffuser wall.

The support structure may comprise a plurality of struts coupled to a main engine casing of the engine, the struts including the apertures.

The apertures may communicate with respective portions of passageways formed through the struts, the passageways supplying cooling fluid from the diffuser section to a first row vane assembly in the turbine section of the engine.

Each of the apertures may be located on a radial axis with a combustor apparatus of the engine.

The gas turbine engine may further comprise a pre-swirl structure located in the cooling fluid channel for swirling the cooling fluid flowing through the cooling fluid channel prior to the cooling fluid reaching the blade disc structure in the turbine section of the engine.

In accordance with a second aspect of the present invention, a gas turbine engine is provided. The gas turbine engine comprises a diffuser section supplying cooling fluid and a cooling fluid channel. The diffuser section comprises an inner diffuser wall including a plurality of apertures extending therethrough such that at least a portion of the cooling fluid passes through the apertures. The cooling fluid channel is in fluid communication with the apertures in the inner diffuser wall for supplying cooling fluid to a blade disc structure located in a turbine section of the engine.

The engine may further comprise support structure, a rotatable shaft, and shaft cover structure, the support structure comprising an axially downstream wall portion, the shaft cover structure disposed about the rotatable shaft and being supported by the support structure, wherein the cooling fluid channel is located between the shaft cover structure and the support structure.

The inner diffuser wall may at least partially define an inner boundary of the diffuser section.

In accordance with a third aspect of the present invention, a gas turbine engine is provided. The gas turbine engine comprises a diffuser section supplying cooling fluid, a rotatable shaft, shaft cover structure disposed about the rotatable shaft, support structure, and a cooling fluid channel. The support structure comprises a plurality of struts providing structural support for the shaft cover structure, the struts receiving cooling fluid from the diffuser section and comprising a plurality of apertures through which at least a portion of the cooling fluid passes. The cooling fluid channel is located between the rotatable shaft and the support structure and is in fluid communication with the apertures in the struts for supplying cooling fluid to a blade disc structure located in a turbine section of the engine.

The struts may be coupled to a main engine casing of the engine.

The apertures may communicate with respective passageways formed through the struts that supply cooling fluid from the diffuser section to a first row vane assembly in the turbine section of the engine.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
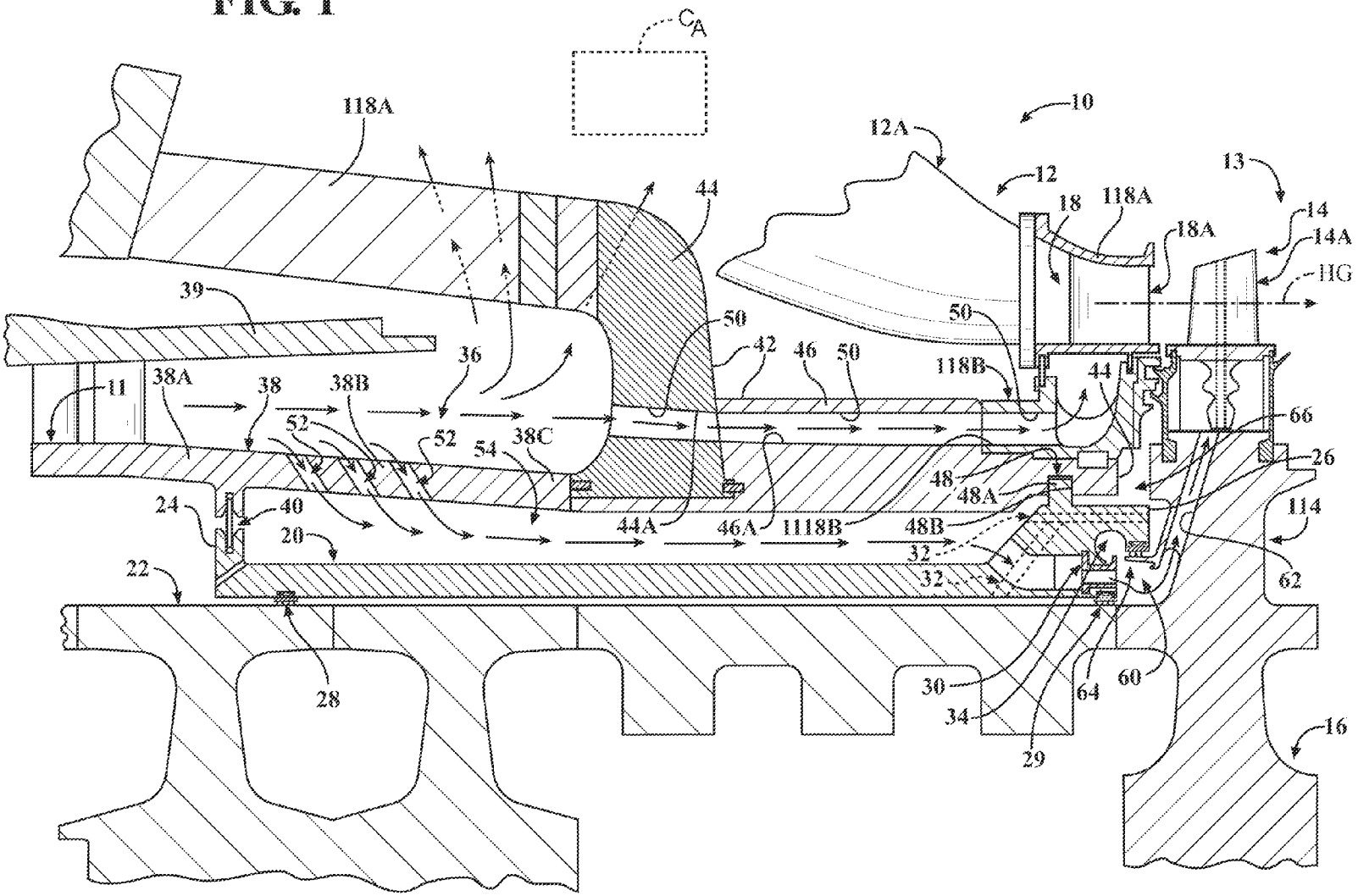
FIG. 1 is a sectional view of a portion of a gas turbine engine according to an embodiment of the invention.

Referring now to FIG. 1, a portion of a gas turbine engine 10 according to an embodiment of the invention is shown. The engine 10 includes a conventional compressor section 11 for compressing air. The compressed air from the compressor section 11 is conveyed to a combustion section 12, which produces hot combustion gases by burning fuel in the presence of the compressed air from the compressor section 11.

The combustion gases are conveyed through a plurality of transition ducts 12A to a turbine section 13 of the engine 10. The turbine section 13 comprises alternating rows of rotating blades 14 and stationary vanes 18. A first row 14A of circumferentially spaced apart blades 14 coupled to a first blade disc structure 114 and a first row 18A of circumferentially spaced apart vanes 18 coupled to an interior side of a main engine casing 118A and a first lower stator support structure 118B are illustrated in FIG. 1. A plurality of the blade disc structures, including the first blade disc structure 114, are positioned adjacent to one another in an axial direction so as to define a turbine section portion of a rotor 16. Each of the blade disc structures supports a plurality of circumferentially spaced apart blades 14 and each of a plurality of lower stator support structures and the main engine casing 118A support a plurality of circumferentially spaced apart vanes 18. The vanes 18 direct the combustion gases from the transition ducts 12A along a hot gas flow path HG onto the blades 14 such that the combustion gases cause rotation of the blades 14, which in turn causes corresponding rotation of the rotor 16.

As shown in FIG. 1, a shaft cover structure 20 surrounds a portion of a shaft 22, which shaft 22 is coupled to the first blade disc structure 114 and comprises a combustion section portion of the rotor 16. It is noted that the shaft cover structure 20 does not rotate with the rotor 16 during operation of the engine 10. The shaft cover structure 20 may comprise two halves or sections that are joined together about the shaft 22, such as, for example, by bolting, although it is understood that the shaft cover structure 20 may be formed from additional or fewer pieces/sections. The shaft cover structure 20 comprises a generally cylindrical member having a forward end portion 24 and an opposed aft end portion 26.

Referring still to FIG. 1, the forward end portion 24 of the shaft cover structure 20 includes a first shaft seal assembly 28 that creates a substantially fluid tight seal with the shaft 22, and the aft end portion 26 of the shaft cover structure 20 includes a second shaft seal assembly 29 that creates a substantially fluid tight seal with the shaft 22. The first and second shaft seal assemblies 28 and 29 may comprise, for example, a rotating structure, such as a knife edge seal, coupled to the shaft 22, which may be in combination with a non-rotating seal structure, such as a honeycomb seal or an abradable material coupled to the respective forward and aft end portions 24 and 26 of the shaft cover structure 20. Other suitable exemplary types of shaft seal assemblies 28, 29 include leaf seals, brush seals, and non-contacting fin seals.

The aft end portion 26 of the shaft cover structure 20 comprises a pre-swirl structure 30 and defines a plurality of bypass passages 32 and a particle collection chamber 34, each of which is described in commonly assigned U.S. patent application Ser. No. 12/758,065, entitled "COOLING FLUID PRE-SWIRL ASSEMBLY FOR A GAS TURBINE ENGINE", filed Apr. 12, 2010, the entire disclosure of which is hereby incorporated by reference herein.

A diffuser section 36 is located radially outwardly from the shaft cover structure 20. The diffuser section 36 is in fluid communication with and receives cooling fluid, e.g., compressor discharge air, from the compressor section 11 of the engine 10. The diffuser section 36 comprises a generally cylindrical inner diffuser wall 38 that at least partially defines an inner boundary of the diffuser section 36 and a generally cylindrical annular outer diffuser wall 39 spaced in the radial direction from the inner diffuser wall 38.

The inner diffuser wall 38 comprises an axially forward portion 38A, an intermediate portion 38B, and an axially aft portion 38C. First seal structure 40, such as, for example, a dog bone seal or diaphragm seal is disposed between the forward end portion 24 of the shaft cover structure 20 and the inner diffuser wall 38 for creating a substantially fluid tight seal therebetween. The aft portion 38C of the inner diffuser wall 38 is rigidly coupled to support structure 42 comprising a plurality of circumferentially spaced apart struts 44 (one shown in FIG. 1) and an axially downstream wall portion 46, each of which will be discussed in detail herein. It is noted that the inner diffuser wall 38 may be integrally formed with the axially downstream wall portion 46, or may be separately formed from and coupled to the axially downstream wall portion 46. Further the struts 44 may be integrally formed with the axially downstream wall portion 46, or may be separately formed from and coupled to the axially downstream wall portion 46. It is also noted that the inner diffuser wall 38 is non-rotatable.

Second seal structure 48 is located between the aft end portion 26 of the shaft cover structure 20 and the axially downstream wall portion 46 of the support structure 42. The second seal structure 48 comprises a member 48A extending radially outwardly from the aft end portion 26 of the shaft cover structure 20, which member 48A is received in a corresponding gap 48B formed in the axially downstream wall portion 46. The second seal structure 48 creates a substantially fluid tight seal between the aft end portion 26 of the shaft cover structure 20 and the wall portion 46. In the embodiment shown, the second seal structure 48 also provides a structural support for the shaft cover structure 20 via the support structure 42, i.e., via a rigid coupling of radially outer ends of the struts 44 to the main engine casing 118A, a rigid coupling of radially inner ends of the struts 44 to the wall portion 46, and a plurality of coupling structures (not shown), such as, for example, pins, that extend and are coupled between the axially downstream wall portion 46 and the second support structure 48 to couple the shaft cover structure 20 to the wall portion 46. It is noted that the support structure 42 is non-rotatable.

The struts 44 cooperate with the wall portion 46 and with the stator support structure 118B to define a plurality of circumferentially spaced apart passageways 50 (one passageway 50 is shown in FIG. 1) for supplying cooling fluid from the diffuser section 36 to the first row vane assembly 18A. Each strut 44 may include a respective bore 44A defining a portion of a corresponding passageway 50 or only select ones of the struts 44 may include a bore 44A, depending on the amount of cooling fluid to be provided to the first row vane assembly 18A. The wall portion 46 of the support structure 42 and the stator support structure 118B include bores 46A and 1118B defining portions of the passageways 50. As clearly shown in FIG. 1, the cooling fluid flowing through the passageways 50 to the first row vane assembly 18A does not enter a cooling fluid channel 54 to be described below.

The diffuser section 36, i.e., the inner diffuser wall 38, comprises a plurality of apertures 52 formed therein for supplying cooling fluid to the cooling fluid channel 54 located radially between the shaft 22 and the support structure 42, and more specifically between the shaft cover structure 20 and the axially downstream wall portion 46. In the embodiment shown, three annular rows of circumferentially spaced apart apertures 52 are provided, with a first row being located in the axially forward portion 38A, a second row being formed axially downstream from the first row, i.e., in the intermediate portion 38B, and a third row being formed axially downstream from the second row, i.e., in the aft portion 38C. While three rows of apertures 52 are provided in the illustrated embodiment, any suitable number of rows and any suitable number of apertures 52 in each row may be provided. It is noted that the number and size of the apertures 52 may vary depending on the amount of cooling fluid desired to be supplied into the channel 54 and also depending on the amount of cooling fluid that must be removed from adjacent to the inner diffuser wall 38 in order to break up/reduce/avoid a boundary layer of cooling fluid at the inner diffuser wall 38, which boundary layer will be discussed in detail herein. In a preferred embodiment, the inner diffuser wall 38 includes only enough apertures 52 to break up/reduce/avoid the boundary layer of cooling fluid. However, if additional cooling fluid is desired to be provided into the channel 54, as will be discussed below, additional apertures 52 could be provided in the inner diffuser wall 38.

The cooling fluid passes into the channel 54 through the apertures 52, and then passes through the channel 54 and enters into the pre-swirl structure 30. As described in detail in the above-noted U.S. patent application Ser. No. 12/758,065, the pre-swirl structure 30 swirls the cooling fluid passing therethrough by imparting to the cooling fluid a velocity component in a direction tangential to the circumferential direction.

The cooling fluid exiting the pre-swirl structure 30 passes into an annular cavity 60 that is located downstream from the pre-swirl structure 30, which annular cavity 60 extends from the pre-swirl structure 30 to a plurality of bores 62 formed in the first blade disc structure 114. While passing through the annular cavity 60, particles may be removed from the cooling fluid by a particle separator 64, as described in the '065 application. It is noted that, a portion of the cooling fluid passing through the channel 54 in the embodiment shown passes through the bypass passages 32 and into a turbine rim cavity 66, also as described in the '065 application.

During operation of the engine 10, cooling fluid, e.g., compressed air from the compressor section 11, is provided to the diffusion section 36. A first portion of the cooling fluid passes from the diffusion section 36 into one or more combustor apparatuses $C_A$ of the combustion section 12 (one such combustor apparatus $C_A$ is schematically illustrated in FIG. 1) where the first portion is burned with fuel to create hot working gases as discussed above.

A second portion of the cooling fluid passes from the diffusion section 36 through the apertures 52 and into the cooling fluid channel 54. The second portion of cooling fluid flows axially through the channel 54 and is distributed into the pre-swirl structure 30 and into the bypass passages 32, as described in the '065 application. The majority of the cooling fluid that passes into the pre-swirl structure 30 is provided into the bores 62 in the first blade disc structure 114 (some passes into the bypass passages 32 and some passes directly into the turbine rim cavity 66 as described in the '065 application) and the cooling fluid that passes into the bypass passages 32 is provided to the turbine rim cavity 66, also as described in the '065 application.

In prior art engines that do not include the apertures 52 in the inner diffuser wall 38 that provide fluid communication directly between the diffuser section 36 and the channel 54, the cooling air passing through the diffuser section tends to form a boundary layer along the inner diffuser wall. The boundary layer formed along the inner diffuser wall in these prior art engines builds up and reduces the total pressure and the effective flow area through the diffuser section, thus decreasing the static pressure rise through the diffuser section 36. A decreased static pressure at the exit of the diffuser section 36 reduces the pressure ratio across downstream components, i.e., the combustor apparatuses $C_A$ and the components in the turbine section 13, and reduces the performance thereof.

However, according to this aspect of the invention, since the cooling fluid is permitted to pass through the apertures 52 in the inner diffuser wall 38, the boundary layer of cooling fluid at the inner diffuser wall 38 is broken up, reduced, or avoided. Hence, the efficiency of the diffuser section 36 is increased and a higher static pressure is available at the diffuser section 36 exit. The higher static pressure at the diffuser section 36 exit raises the pressure ratio across the downstream components, i.e., the combustor apparatuses $C_A$ and the components in the turbine section 13, and improves the performance thereof, which increases the power and efficiency of the engine 10. The higher diffuser exit static pressure will also be available at the passageway 50 for increased cooling fluid flow pressure to the first row vane assembly 18A.

Further, since the cooling fluid that is to be delivered to the first blade disc structure 114 and to the turbine rim cavity 66 from the channel 54 is provided directly from the diffuser section 36 to the channel 54 through the apertures 52, external cooling pipes, which are provided in prior art engines to provide cooling fluid to the channel 54, are not required. As these prior art cooling pipes typically extend through the diffuser section 36, in the current invention, which does not require the external cooling pipes, there is less structure extending through the diffuser section 36, thus further increasing the effective flow area through the diffuser section 36, i.e., by increasing the actual flow area through the diffuser section 36 and reducing blockage of the cooling fluid passing through the diffuser section 36 on its way to the combustor(s).

Figure 2:
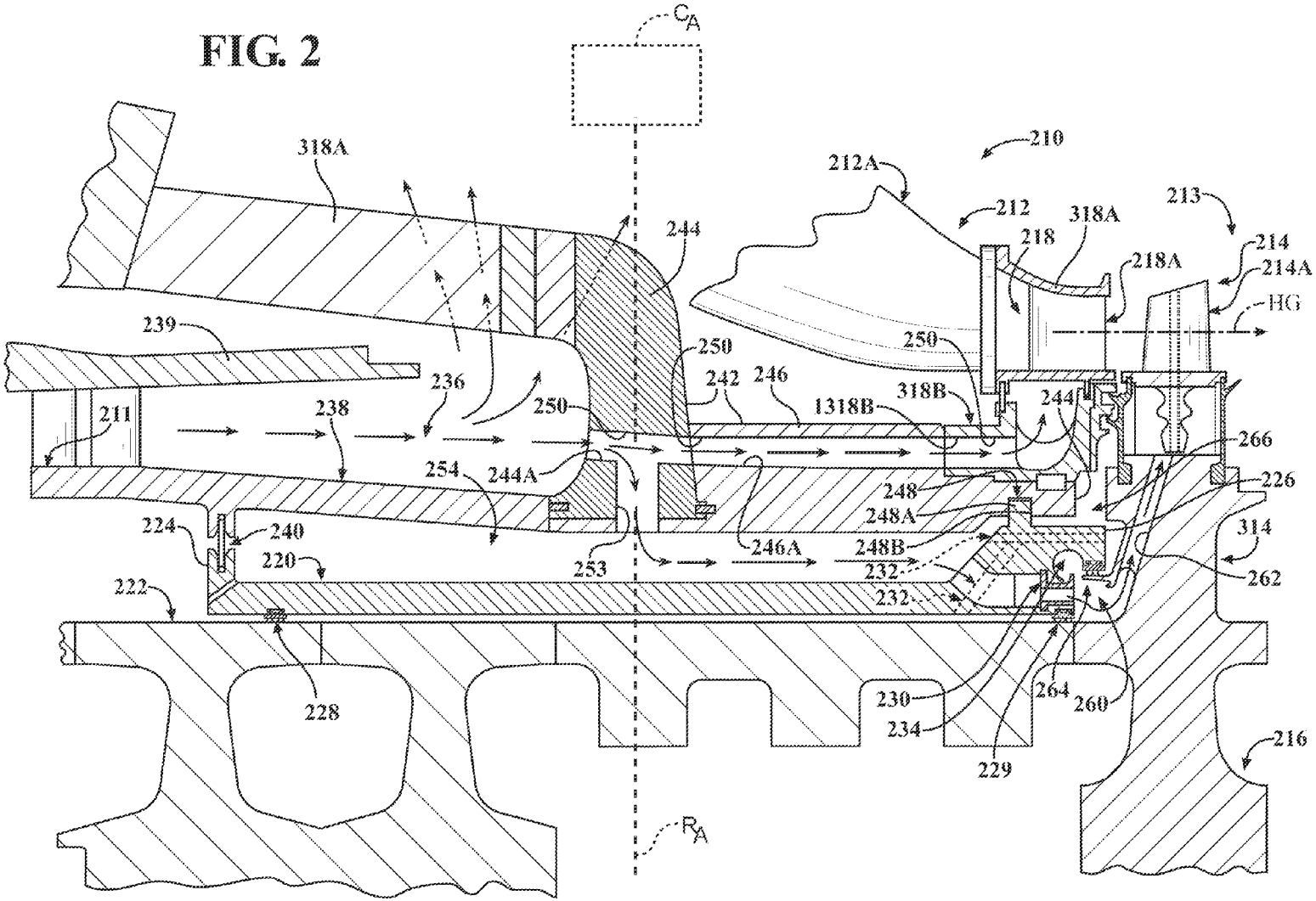
FIG. 2 is a sectional view of a portion of a gas turbine engine according to another embodiment of the invention.

Referring now to FIG. 2, a gas turbine engine 210 is illustrated, where structure similar to that described above with reference to FIG. 1 includes the same reference number increased by 200. The majority of the structure and the function of the engine 210 according to this embodiment are generally the same as for the engine 10 described above, and, thus, will not be discussed in detail with respect to FIG. 2.

The inner diffuser wall 238 according to this embodiment does not include apertures that provide direct communication between the diffuser section 236 and the cooling fluid channel 254. Rather, according to this embodiment, at least some of the struts 244 include apertures 253 formed therein for providing cooling fluid from the diffuser section 236 into the channel 254. Specifically, the apertures 253 according to this embodiment are in fluid communication with respective bores 244A that are formed in the struts 244, which bores 244A define portions of respective passageways 250.

A first portion of cooling fluid passing from the diffuser section 236 into the passageways 250 is directed through the apertures 253 into the cooling fluid channel 254. This first portion of cooling fluid passes through the pre-swirl structure 230 and the bypass passages 232 and into the first blade disc structure 314 and the turbine rim cavity 266 as described above with reference to FIG. 1. It is noted that the number and size of the apertures 253 may vary depending on the amount of cooling fluid desired to be supplied into the channel 254. Each of the apertures 253 according to a preferred embodiment of the invention is located on a radial axis $R_A$ with one or more combustor apparatuses $C_A$ of the combustion section 212, one such combustor apparatus $C_A$ is schematically illustrated in FIG. 2.

A second portion of the cooling fluid that passes from the diffuser section 236 into the passageways 250 is provided to the first row vane assembly 218A, as described above with reference to FIG. 1. Similar to the engine 10 described above with reference to FIG. 1, the cooling fluid passing to the first row vane assembly 218A through the passageways 250 does not enter the cooling fluid channel 254.

Struts, such as the struts 44 disclosed above with reference to FIG. 1, i.e., without the apertures 253 formed therein, may be employed to provide structural support for the shaft cover structure 20 via the main engine casing 118A. One such engine configuration where a strut supports the shaft cover structure is disclosed in commonly assigned U.S. patent application Ser. No. 12/564,194 entitled "COVER ASSEMBLY FOR GAS TURBINE ENGINE ROTOR", filed Sep. 22, 2009, the entire disclosure of which is hereby incorporated by reference herein (in the '194 application, the strut is referred tows an "arm member"). By providing the cooling fluid into the channel 254 through the apertures 253 in the struts 244 according to this embodiment of the invention, additional structures, such as external cooling pipes, are not needed to provide cooling fluid into the channel 254, thus reducing the amount of structure that extends through the diffuser section 36. Reducing the amount of structure in the diffuser section 236 results in an increase in the effective flow area through the diffuser section 236 over prior art engines that employ additional structures, e.g., external cooling pipes, to provide cooling fluid into the channel 254. This increase in the effective flow area through the diffuser section 236 is effected by increasing the actual flow area through the diffuser section 36 and reducing blockage of the cooling fluid passing through the diffuser section 36 on its way to the combustor(s), which blockage is caused by the cooling fluid contacting structures in the diffuser section 236.

Moreover, according to this aspect of the invention, the cooling fluid passes entirely through the diffuser section 236 before being introduced into the channel 254, since the bores 244A in the struts 244 that provide the cooling fluid into the apertures 253 are located adjacent to the end of the diffuser section 236. Hence, the velocity and temperature of the cooling fluid are lower and the static pressure of the cooling fluid is higher than if the cooling fluid were to be introduced into the channel 254 prior to the air fully passing through the diffuser section 236, thus increasing the efficiency of the engine 210.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine engine comprising:

a diffuser section supplying cooling fluid and including an inner diffuser wall that at least partially defines an inner boundary of said diffuser section;

a rotatable shaft;

shaft cover structure disposed about said rotatable shaft;

support structure providing structural support for said shaft cover structure, said support structure receiving cooling fluid from said diffuser section and comprising a plurality of circumferentially spaced apart struts;

said inner diffuser wall comprising a plurality of apertures through which at least a portion of said cooling fluid passes, at least one of said apertures extending through an axially forward portion of said inner diffuser wall upstream from said support structure; and a cooling fluid channel between said shaft cover structure and said support structure, said cooling fluid channel in fluid communication with said apertures in said inner diffuser wall for supplying cooling fluid to a blade disc structure located in a turbine section of the engine.

2. The gas turbine engine of claim 1, wherein said diffuser section is in fluid communication with a compressor section of the engine, said cooling fluid being provided to said diffuser section from the compressor section.

3. The gas turbine engine of claim 1, wherein at least one of said apertures is located upstream from said support structure and axially downstream from said at least one aperture extending through said axially forward portion of said inner diffuser wall.

4. The gas turbine engine of claim 1, wherein said circumferentially spaced apart struts are coupled at radially outer ends thereof to a main engine casing of the engine.

5. The gas turbine engine of claim 4, wherein said struts include passageways that receive cooling fluid from said diffuser section and supply the cooling fluid to a first row vane assembly in the turbine section of the engine, wherein the cooling fluid supplied to the first row vane assembly by said struts does not enter said cooling fluid channel.

6. The gas turbine engine of claim 1, further comprising a pre-swirl structure located in said cooling fluid channel for swirling the cooling fluid flowing through said cooling fluid channel prior to the cooling fluid reaching the blade disc structure in the turbine section of the engine.

7. The gas turbine engine of claim 5, wherein said cooling fluid channel is bounded by said shaft cover structure and said support structure.

8. The gas turbine engine of claim 1, wherein said cooling fluid channel is bounded by said shaft cover structure and said support structure.

9. A gas turbine engine comprising:

a rotatable shaft;

shaft cover structure disposed about said rotatable shaft;

a diffuser section supplying cooling fluid, said diffuser section comprising an inner diffuser wall including a plurality of apertures extending therethrough such that at least a portion of said cooling fluid passes through said apertures, wherein at least one of said apertures is located axially downstream from another of said apertures;

support structure providing structural support for said shaft cover structure, said support structure comprising a plurality of circumferentially spaced apart struts coupled at radially outer ends thereof to a main engine casing of the engine, wherein said struts include passageways that receive cooling fluid from said diffuser section and supply the cooling fluid to a first row vane assembly in the turbine section of the engine; and a cooling fluid channel bounded by said shaft cover structure and said support structure and in fluid communication with said apertures in said inner diffuser wall for supplying cooling fluid to a blade disc structure located in a turbine section of the engine.

10. The gas turbine engine of claim 9, wherein said diffuser section is in fluid communication with a compressor section of the engine, said cooling fluid being provided to said diffuser section from the compressor section.

11. The gas turbine engine of claim 9, wherein said inner diffuser wall at least partially defines an inner boundary of said diffuser section.

12. The gas turbine engine of claim 11, wherein at least one of said apertures extends through an axially forward portion of said inner diffuser wall.

13. The gas turbine engine of claim 9, wherein the cooling fluid supplied to the first row vane assembly by said struts does not enter said cooling fluid channel.

14. A gas turbine engine comprising:

a diffuser section supplying cooling fluid;

a rotatable shaft;

shaft cover structure disposed about said rotatable shaft;

support structure comprising a plurality of circumferentially spaced apart struts providing structural support for said shaft cover structure, said struts comprising respective passageways formed therein receiving cooling fluid from said diffuser section and comprising a plurality of apertures in communication with said passageways through which a first portion of said cooling fluid from said passageways passes;

a cooling fluid channel between said rotatable shaft and said support structure, said cooling fluid channel in fluid communication with said apertures in said struts for supplying the first portion of cooling fluid from said passageways to a blade disc structure located in a turbine section of the engine; and wherein a second portion of said cooling fluid from said passageways does not enter said cooling fluid channel and is provided to a first row vane assembly in the turbine section of the engine.

15. The gas turbine engine of claim 14, wherein said diffuser section is in fluid communication with a compressor section of the engine, said cooling fluid being provided to said diffuser section from the compressor section.

16. The gas turbine engine of claim 14, wherein radially outer ends of said struts are coupled to a main engine casing of the engine and radially inner ends of said struts are coupled to an axially downstream wall portion of said support structure.

17. The gas turbine engine of claim 14, wherein each of said apertures is located on a radial axis with a combustor apparatus of the engine.

18. The gas turbine engine of claim 14, wherein said cooling fluid channel is bounded by said shaft cover structure and said support structure.

* * * * *